United States Patent [19]

O'Connor

[11] Patent Number: 4,995,787

[45] Date of Patent: Feb. 26, 1991

[54] AXIAL FLOW IMPELLER

[75] Inventor: John F. O'Connor, Torrington, Conn.

[73] Assignee: Torrington Research Company, Torrington, Conn.

[21] Appl. No.: 408,744

[22] Filed: Sep. 18, 1989

[51] Int. Cl.[5] ..... B63H 7/00; F01D 5/00

[52] U.S. Cl. ..... 416/228; 416/234; 416/238; 415/119

[58] Field of Search ..... 415/119; 416/228, 234, 416/238, 242, 241 A, 186 R

[56] References Cited

U.S. PATENT DOCUMENTS

| | | | |
|---|---|---|---|
| 3,449,605 | 6/1969 | Wilson | 416/228 R |
| 4,358,245 | 11/1982 | Gray | 416/238 |
| 4,569,631 | 2/1986 | Gray, III | 416/238 |
| 4,684,324 | 8/1987 | Perosino | 415/119 |
| 4,840,541 | 6/1989 | Sakane et al. | 415/119 |

*Primary Examiner*—Edward K. Look

*Assistant Examiner*—Hoang Nguyen

*Attorney, Agent, or Firm*—McCormick, Paulding & Huber

[57] ABSTRACT

An axial flow air impeller for automotive radiator fan use and the like comprising a hub carrying a plurality of integrally formed similar circumaxially spaced and generally radially outwardly projecting air moving blades. Each blade has a root end portion integral with the hub and a radially outwardly disposed tip end portion with smoothly curving leading and trailing edges extending therebetween. The leading edge curves substantially forwardly while the trailing edge extends substantially radially to provide for a blade projected width at the tip end portion approximately 40% greater than at the root end portion. The thickness of each blade varies from a maximum at the root end portion to a minimum at the tip end portion with the latter being at least three times the thickness at the blade edge. An integral orifice ring circumscribes the plurality of blades and has a bell mouth at its upstream or downstream end.

7 Claims, 1 Drawing Sheet

AXIAL FLOW IMPELLER

BACKGROUND OF THE INVENTION

A variety of axial flow fan designs have been employed in cooling automotive radiators and in similar heat exchanger applications and, while certain designs have been generally satisfactory, no single impeller design has been completely satisfactory in all respects.

It is the general object of the present invention to provide an improved axial flow air impeller which represents a judicious compromise of design objectives such as minimum noise generation, highly efficient aerodynamic operation and economy of material and manufacture.

SUMMARY OF THE INVENTION

In fulfillment of the foregoing object, an improved axial flow air impeller for automotive radiator fan use or the like comprises a hub adapted for rotation about an axis and carrying a plurality of integrally formed similar circumaxially spaced air moving blades. The blades project generally radially outwardly from the hub and each blade has a root end portion integral with the hub and a radially outwardly disposed tip end portion with smoothly curving oppsite side edges between the root and tip end portions. The air impeller is adapted for unidirectional rotation and, accordingly, the side edges comprise leading and trailing edges of the blades.

In accordance with the present invention, the leading edge of each blade curves substantially forwardly when viewed from the root end portion to the tip end portion and, as a result, the projected width of each blade is at least 40% greater at the tip end portion than at the root end portion. Preferably, and in the presently favored design, the tip end portion of each blade is approximately 40% to 80% wider than the root end portion thereof.

The maximum thickness of each fan blade also varies from a maximum at the root end portion to a minimum at the tip end portion and the maximum thickness at the tip end portion is preferably at least three times the thickness at the blade trailing edge.

Finally, an orifice ring is formed integrally with each blade tip end portion and circumscribes the plurality of blades. The ring has upstream and downstream ends and is provided with a smooth radius and is optionally at least approximately bell mouthed as illustrated at its upstream or downstream end.

DESCRIPTION OF PREFERRED EMBODIMENT

Figure 1:
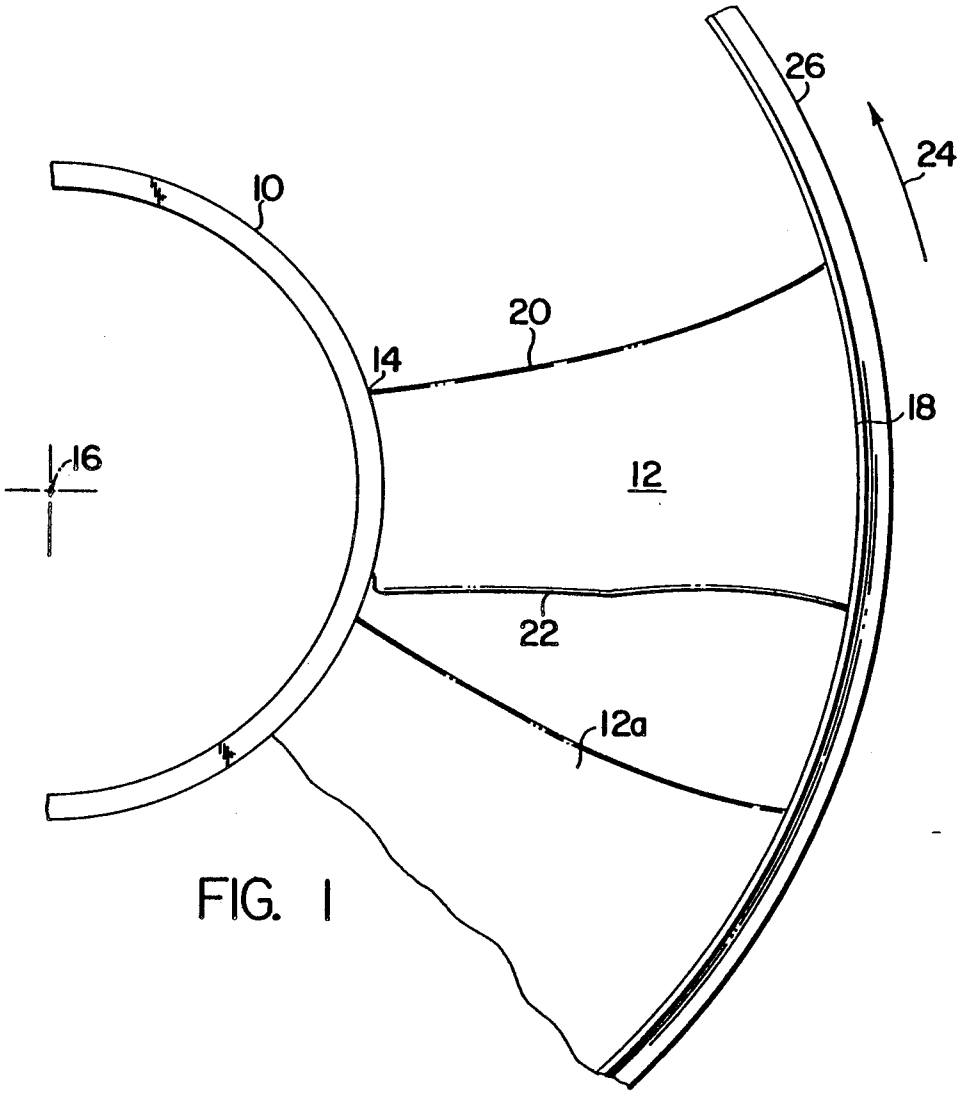
FIG. 1 is a fragmentary rear view of an improved axial flow air impeller constructed in accordance with the present invention.

Referring particularly to FIG. 1, it will be observed that a hub is partially shown and indicated generally by the reference numberal 10. The hub 10 may be rotated by an output shaft of an electric motor, a belt drive from an internal combustion engine etc., and serves to support and rotate a plurality of air moving blades. An air moving blade 12 is illustrated at 12 and a second air moving blade is partially illustrated at 12*a*. The air impeller shown is provided with nine (9) identical blades equally spaced circumaxially and each blade projects radially outwardly from the hub 10. Preferably, the impeller is of molded plastic construction and the hub 10 and blades 12 are formed integrally. That is, a root end portion of each blade 12 is formed integrally with the hub 10 and the blade projects generally radially outwardly from the hub to its termination 18.

Figure 2:
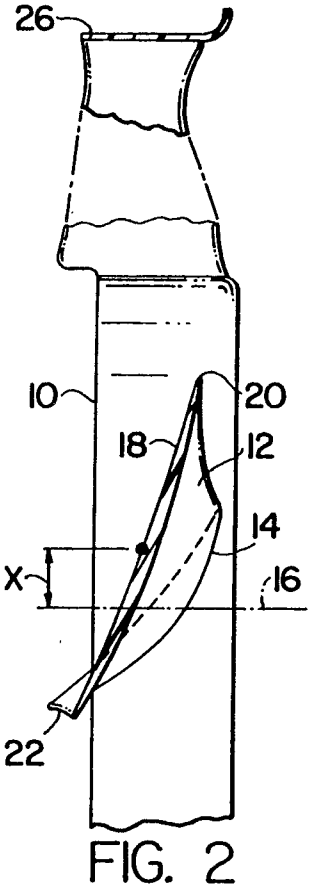
FIG. 2 is a fragmentary side view of the air impeller of FIG. 1.

A root end portion of the blade 12 is illustrated at 14 and, as best shown in FIG. 2, the root end portion 14 of the blade 12 is inclined or arranged at an angle of "pitch" relative to an axis of rotation 16. As will be apparent in FIG. 2, blade "pitch" decreases from the root end portion to the tip end portion 18 of the blade 12.

The blade 12 has smoothly curved side edges extending between its root end portion 14 and its tip end portion 18 and, more particularly, the blade has a leading edge 20 and a trailing edge 22. The air impeller of the present invention is unidirectional and rotates in a counterclockwise direction as illustrated in FIG. 1 by the directional arrow 24.

In accordance with the present invention, the leading edge of each blade 12 of the impeller of the present invention is curved substantially forwardly when viewed from root end portion to tip end portion and the width of each blade is thus increased substantially in progression from the root end portion to the tip end portion. That is, the trailing edge of each blade 12 is preferably at least approximately radial as illustrated in FIG. 1 such that a substantial increase in blade width or "chord" occurs as a result of the forward sweep of the blade leading edge 20. Preferably, at least a 40% increasee in blade projected width occurs throughout blade length and, as illustrated, the blade is substantially twice as wide at its tip end portion as at its root end portion thus showing a 100% increase in width. Further, the forward sweep of the leading edge of the blade preferably occurs at a radially outwardly disposed portion thereof. Thus, the major portion of the forward curve at the leading edge of each blade preferably occurs at the outer one-half of the blade length measured from the root end portion to the tip end portion and, more specifically, at the outer one-third of the blade length so measured.

The forward sweep of the leading edge of each of the blades 12 substantially improves the time incidence differential for radial points along the outer portion of the blade leading edge. This results in a significant reduction in noise generation.

In observation of FIG. 2, it will be observed that a significant variation in thickness occurs as the blade progresses from its root end portion 14 to its tip end portion 18, the thickness of the blade being substantially reduced. The thickness variation is designed to minimize stress in the blades and at the same time reduce to the extent possible the amount of material required to make the blade relative to a uniform thickness blade of the same strength. The maximum blade thickness $T_{max}$ near the root portion of the blade is judiciously selected as are various section thickness along the length of the blade from its root end portion to its tip end portion. That is, the blade thickness $T_s$ at any blade section may be determined as follows:

$$Ts = Tmax\ (r_s/r_{root})^x$$

where:

$T_s$=blade thickness at the measured section, s

Tmax = maximum blade thickness near the root tip end portion $r_s$ = radius ratio x at section s $r_{root}$ = section radius at blade root end x = between 1.0 and 0.5 (value assigned so that minimum value of $T_s$ will not be less than 3 times thickness at blade trailing edge).

In order that the minimum value of blade thickness $T_s$ will not be less than three times the thickness of the blade edge, the value of x is selected as above falling between 1.0 and 0.5 as indicated. The limit of three times the thickness of the blade edge is desirable but a limit of four times blade edge thickness is regarded as well within the scope of the invention.

As will be apparent from the foregoing, the blade mid-chord points are gradually shifted forwardly in progression from the root end portion of the blade to the tip end portion by the forward sweep of the blade leading edge. Thus, the dimension x shown in FIG. 2 may represent an approximate overall forward shift of the blade mid-chord point from the root end portion of the blade to the tip end portion thereof.

Finally, and further in accordance with the present invention, the improved air impeller is provided with an orifice ring partially shown at 26. The orifice ring 26 is formed integrally with the outer end portion 18 of the blade 12 and is similarly formed with the remaining nine blades of the impeller so as to circumscribe the plurality of blades forming the impeller. As best illustrated in FIG. 2, the impeller has upstream and downstream edges or ends and the upstream or downstream edge or end thereof is at least approximately bell mouthed. This of course serves to provide for a smooth flow of air into or from the fan blades and tends to prevent blade to blade leakage of air around the tips of the blades. Obviously, the outer surface of the orifice ring may be contoured to match an associated housing or other opening in which the impeller is mounted. Clearence employed between the moving and stationary surfaces at the outer diameter of the ring can be provided at normal manufacturing tolerances found in high volume commerical applications. With this arrangement a better air seal is achieved than can be obtained using a conventional air impeller design without an orifice ring but employing very tight running tolerances. That is, a clearance of 0.10 with the ring will match a clearance of 0.005 without a ring.

As mentioned, the improved axial flow air impeller of the present invention provides for very low operating noise, maximum aerodynamic efficiency, improved mechanical strength and minimum material usage in manufacture. The thickness variation minimizes stress in the blades and at the same time reduces the amount of material required to make the blades. The addition of the orifice ring provides lateral stiffness to the impeller blades which accommodates the relatively thin blade sections, this in addition to the primary function of the orifice ring in reducing blade tip leakage. The reduction in blade tip leakage contributes directly to higher aerodynamic efficiency and the resulting decrease in flow distrubance around the blade tips serve still further to reduce noise generation.

I claim:

1. An axial flow air impeller for automotive radiator, heat exchanger use and the like comprising a hub adapted for rotation about an axis and carrying a plurality of integrally formed similar circumaxially spaced and generally radially outwardly projecting air moving blades, each of said blades having a root end portion integral with the hub and a radially outwardly disposed tip end portion with smoothly curving side edges therebetween, said air impeller being adapted for undirectional rotation and said side edges comprising leading and trailing viewed from root end portion to tip end portion, the projected width of each blade thus being at least 40% greater at the tip end portion than at the root end portion, the maximum thickness of each blade varying from a maximum at the root end portion to a minimum at the tip end portion, and the maximum thickness at the tip end portion being at least three times the thickness at the blade trailing edge, and an orifice ring integral with each blade tip end portion and circumscribing the plurality of blades, said ring having upstream and downstream ends and having a flange at one end with a substantially smooth radius at the junction with the ring portion.

2. An axial flow air impeller as set forth in claim 1 wherein said blade trailing edges extend at least approximately along radial lines, the blade mid-chord points thus being gradually shifted forwardly in progression from root end portion to tip end portion by the forward sweep of the blade leading edges.

3. An axial flow air impeller as set forth in claim 1 wherein the forward curve of each blade leading edge is such that blade width is approximately 40% to 80% greater at the tip end portion than at the root end portion.

4. An axial flow air impeller as set forth in claim 1 wherein the maximum blade thickness at each blade tip end portion is at least three times the thickness at the blade trailing edge.

5. An axial flow air impeller as set forth in claim 2 wherein the major portion of the forward curve at the leading edge of each blade occurs at the outer one-half of the blade measured from the root end portion to the tip end portion.

6. An axial flow air impeller as set forth in claim 5 wherein the major portion of the forward curve at the leading edge of each blade occurs at the outer one-third of the blade measured from the root end portion to the tip end portion.

7. An axial flow air impeller as set forth in claim 1 wherein blade thickness at any blade section is:

$$Ts = Tmax\ (r_s/r_{root})x$$

where:

$T_s$ = blade thickness at the measured section, s

Tmax = maximum blade thickness near the root tip end portion $r_s$ = radius ratio x at section s $r_{root}$ = section radius at blade root end x = between 1.0 and 0.5 (value assigned so that minimum value of $T_s$ will not be less than 3 times thickness at blade trailing edge).

* * * * *

UNITED STATES PATENT AND TRADEMARK OFFICE

CERTIFICATE OF CORRECTION

PATENT NO. : 4,995,787

DATED : February 26, 1991

INVENTOR(S) : John F. O'Connor

It is certified that error appears in the above-identified patent and that said Letters Patent is hereby corrected as shown below:

COLUMN 4

Claim 1, after "trailing" line 12, insert--edges the former of which curves substantially forwardly when--.

Signed and Sealed this

Twenty-eighth Day of July, 1992

*Attest:*

DOUGLAS B. COMER

*Attesting Officer*

*Acting Commissioner of Patents and Trademarks*